United States Patent [19]

Yamada et al.

[11] Patent Number: 4,866,481

[45] Date of Patent: Sep. 12, 1989

[54] IMAGE FORMING APPARATUS HAVING A PLURALITY OF DEVELOPERS AND A DETECTION AND CONTROL ARRANGEMENT FOR DETECTING THE DENSITY OF A FORMED IMAGE AND A CONTROLLER FOR CONTROLLING THE DENSITY OF THE IMAGE

[75] Inventors: Takanobu Yamada; Kenji Tabuchi, both of Toyokawa, Japan

[73] Assignee: Minolta Camera Kabushiki Kaisha, Osaka, Japan

[21] Appl. No.: 88,263

[22] Filed: Aug. 24, 1987

[30] Foreign Application Priority Data

Aug. 26, 1986 [JP] Japan ..... 61-200361

[51] Int. Cl.[4] ..... G03G 15/00; G03G 15/01

[52] U.S. Cl. ..... 355/246; 355/214; 355/326

[58] Field of Search ..... 355/3 DD, 14 D, 4; 118/656-658, 688, 689

[56] References Cited

U.S. PATENT DOCUMENTS

| | | | |
|---|---|---|---|
| 4,246,867 | 1/1981 | Hudson | 118/658 X |
| 4,277,162 | 7/1981 | Kasahara et al. | 355/14 D X |
| 4,277,549 | 7/1981 | Tatsumi et al. | 355/14 D X |
| 4,313,671 | 2/1982 | Kuru | 355/14 D |
| 4,607,944 | 8/1986 | Rushing | 355/14 D |

FOREIGN PATENT DOCUMENTS

| | | | |
|---|---|---|---|
| 3526878A1 | 1/1986 | Fed. Rep. of Germany | 355/4 |
| 103359 | 8/1979 | Japan | 355/14 D |
| 80865 | 5/1985 | Japan | 355/4 |
| 153063 | 8/1985 | Japan | 355/4 |
| 192968 | 10/1985 | Japan | 355/14 D |

*Primary Examiner*—A. T. Grimley
*Assistant Examiner*—Edward Pipala
*Attorney, Agent, or Firm*—Burns, Doane, Swecker & Mathis

[57] ABSTRACT

An image forming apparatus including a rotatable electrostatic latent image support member, a corona charger, an exposure device, a first developing device confronting the support member and having an effective developing width for developing an electrostatic latent image formed on the support member, a second developing device confronting the support member upstream of the first developing device in a rotational direction of the support member and having an effective developing width for developing, on the support member, not only a first area not to be developed by the first developing device but a second area for forming the electrostatic latent image, a device for forming, in the first area, a reference latent image for detecting a density of the image, a detection device for detecting a density of a reference toner image obtained by developing the reference latent image by the second developing device and a control device for controlling, on the basis of a detection signal from the detection device, the density of the image formed by the second developing device.

10 Claims, 2 Drawing Sheets

IMAGE FORMING APPARATUS HAVING A PLURALITY OF DEVELOPERS AND A DETECTION AND CONTROL ARRANGEMENT FOR DETECTING THE DENSITY OF A FORMED IMAGE AND A CONTROLLER FOR CONTROLLING THE DENSITY OF THE IMAGE

BACKGROUND OF THE INVENTION

The present invention generally relates to an image forming apparatus for forming an image by using a plurality of developing devices and more particularly, to control of density of toner in the image forming apparatus.

Generally, in known developing devices utilizing a developer composed of a mixture of toner and carrier, since the toner in the developer is consumed upon developing of an electrostatic latent image, it is necessary to perform replenishment of the toner corresponding, in amount, to a drop in density of the toner due to consumption of the toner for developing.

In order to control replenishment of the toner, there has been employed, for example, a method (referred to as "AIDC", hereinbelow) in which after a reference latent image is formed on a surface of a photosensitive (photoreceptor) drum acting as an electrostatic latent image support member and then, is developed into a reference image, density of the reference image is detected optically and the developing device is replenished with the toner in accordance with the detected value of the density of the reference image such that a content of the toner in the developer in the developing device is maintained at a constant value at all times.

Namely, the AIDC is based on such a principle that since the density of the developed image on the surface of the photosensitive drum is proportional to the content of the toner in the developer, changes in the density of the reference image are detected such that replenishment of the toner to the developing device is controlled in accordance with the changes.

Meanwhile, also in image forming apparatuses coming into wide use recently, especially in image forming apparatuses of a type in which a plurality of imaging units each constituted by a corona charger, an exposure means and a developing device are arranged around the photosensitive drum in a rotational direction of the photosensitive drum and toners having different tones are, respectively, contained in the developing devices such that multi-color images are formed, the density of the toner in the developer in each developing device is required to be maintained at a constant value by employing the AIDC.

However, in the known apparatuses of this kind, it has been so arranged that the reference images corresponding to the respective developing devices are formed on an identical line oriented in the rotational direction of the photosensitive drum and that developing areas of the respective developing devices are set at an identical location. Therefore, a reference latent image developed by a first developing device is afterwards developed repeatedly by second and third developing devices disposed downstream of the first developing device and thus, mixing of colors of the reference image takes place.

Needless to say, in order to obviate this problem, a compensating charger or the like is provided between the image forming processes and an electric potential of the reference image formed by the preceding developing device is dropped substantially to an electric potential of the background such that the toner is prevented from being recoated on the preceding reference image by the subsequent developing device. However, the compensated electric potential is not necessarily stable owing to such factors as environmental change with time, deterioration of the photosensitive material, variations in output of the compensating charger, etc. Hence, the known image forming apparatuses have such a drawback that mixing of the colors of the reference image is unavoidable. Especially, in the case where the first developing device contains color toner and the second developing device contains black toner, such a problem arises that when the black toner is recoated on the reference image formed of the color toner, quantity of reflected light varies excessively due to a large difference in reflectance between the color toner and the black toner even if amount of the black toner recoated on the reference image formed of the color toner is minute, thereby making it impossible to perform accurate control of replenishment of the toner.

SUMMARY OF THE INVENTION

Accordingly, the present invention has for its object to eliminate the above described disadvantages inherent in the conventional image forming apparatuses and provides an image forming apparatus equipped with a plurality of developing devices, in which a reference latent image for an upstream developing device is formed outwardly of a reference latent image for a downstream developing device and a developing area for the downstream developing device is set inwardly of the reference latent image for the upstream developing device.

BRIEF DESCRIPTION OF THE DRAWINGS

This object and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
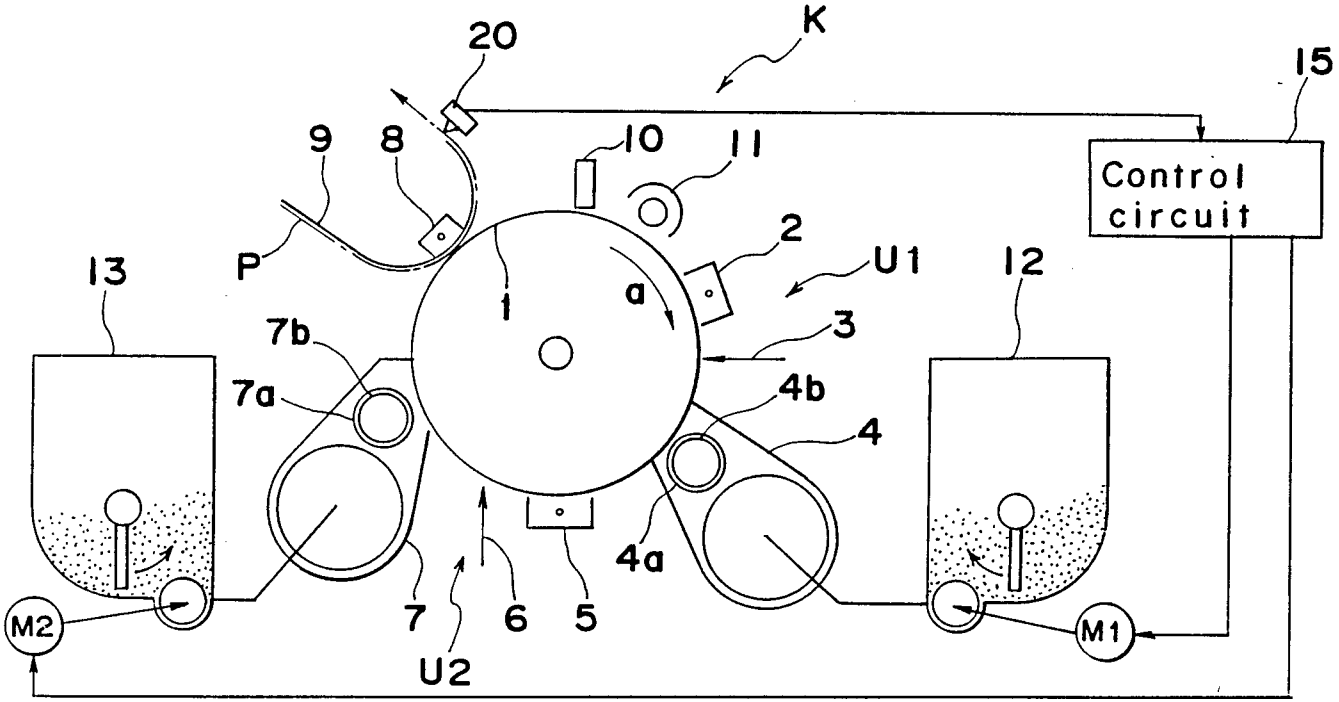
FIG. 1 is a schematic view showing a principle of an image forming apparatus according to one preferred embodiment of the present invention.

FIG. 1 shows a principle of a two-color printer K provided with two developing devices, according to one preferred embodiment of the present invention. The printer K includes a photosensitive drum 1 driven for its rotation in the direction of the arrow a. A first imaging unit U1, a second imaging unit U2, a transfer charger 8, a tractor 9, a blade type cleaning device 10 and a main eraser lamp 11 are arranged around the photosensitive drum 1 in the rotational direction of the photosensitive drum 1. The first imaging unit U1 is constituted by a first corona charger 2, a first optical system 3 and a first developing device 4, while the second imaging unit U2 is constituted by a second corona charger 5, a second optical system 6 and a second developing device 7.

The first and second corona chargers 2 and 5 are arranged to uniformly impart electric charge of a predetermined property (in this embodiment, electric charge of positive polarity) to a surface of the photosensitive drum 1 by corona discharge. Meanwhile, the first and second optical systems 3 and 6 are arranged to form an image into an electrostatic latent image of a negative on the surface of the photosensitive drum 1 by using laser beams. The first and second developing devices 4 and 7 are of a known magnetic brush type. Namely, the first developing device 4 includes a developing sleeve 4*a* having a magnetic roller 4*b* incorporated therein, while the second developing device 7 includes a developing sleeve 7*a* having a magnetic roller 7*b* incorporated therein. Two-component developer composed of toner and carrier is held, in a state of a magnetic brush, on each of surfaces of the developing sleeves 4*a* and 7*a*. The magnetic brush rubs against the surface of the photosensitive drum 1 so as to develop the electrostatic latent image.

A first developer composed of a mixture of color toner (a first toner) and carrier is contained in the first developing device 4, while a second developer composed of a mixture of black toner (a second toner) and carrier is contained in the second developing device 7. In this embodiment, the toners are electrically charged frictionally to positive polarity, while the carrier is electrically charged frictionally to negative polarity. Meanwhile, the first and second developing devices 4 and 7 are, respectively, provided with toner replenishing devices 12 and 13 so as to be replenished with the toners through drive of motors M1 and M2 in response to replenishment signals from a toner replenishment control circuit 15.

Figure 2:
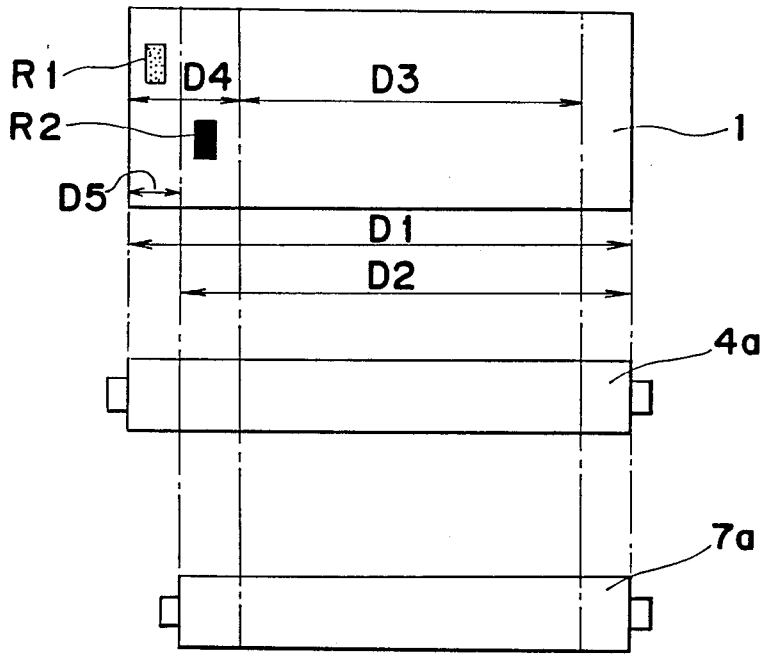
FIG. 2 is a view showing developing areas of respective developing devices employed in the image forming apparatus of FIG. 1.

As will be seen from FIG. 2 showing positions of the developing sleeves 4*a* and 7*a* relative to the photosensitive drum 1, a developing area D1 developed by the developing sleeve 4*a* in the first developing device 4, namely a width of the magnetic brush formed on the surface of the developing sleeve 4*a* corresponds to a width of the photosensitive drum 1. Meanwhile, a developing area D2 developed by the developing sleeve 7*a* in the second developing device 7, namely a width of the magnetic brush formed on the surface of the developing sleeve 7*a* has a width smaller than that of the developing area D1. Therefore, a developing area D5, which is not developed by the developing sleeve 7*a* of the second developing device 7, is formed at a left end portion in the developing area D1.

However, a print area D3 in which an image is actually printed on a transfer paper P is set inwardly of the developing areas D1 and D2 and an area outside the print area D3 is set as a non-print area D4. The transfer charger 8 imparts electric charge of negative polarity to the transfer paper P transported to a transfer region in the direction of the arrow by the tractor 9 so as to transfer to the transfer paper P, the toner image adhering electrostatically to the surface of the photosensitive drum 1.

Hereinbelow, an image forming process of the image forming apparatus K of the above described arrangement is described. In a state where the photosensitive drum 1 is driven so as to be rotated in the direction of the arrow a at a constant speed, first corona charging is initially performed by the first corona charger 2 such that electric charge is imparted to the surface of the photosensitive drum 1. Subsequently, first exposure is performed by the first optical system 3 so as to form an electrostatic latent image for the first color on the surface of the photosensitive drum 1. Then, the electrostatic latent image for the first color is developed by the first developing device 4 such that the color toner electrically charged to positive polarity adheres to the electrostatic latent image for the first color.

Thereafter, second corona charging is performed by the second corona charger 5 so as to compensate for a surface potential of the photosensitive drum 1. Then, second exposure is performed by the second optical system 6 so as to form an electrostatic latent image for the second color on the surface of the photosensitive drum 1. Subsequently, the electrostatic latent image for the second color is developed by the second developing device 7 such that the black toner electrically charged to positive polarity adheres to the electrostatic latent image for the second color.

On the other hand, the transfer paper P in a continuous form is transported in the direction of the arrow by the tractor 9. Upon electric discharge of negative polarity by the transfer charger 8, the toner image formed by the color toner and the black toner is transferred to the transfer paper P. Then, the toner image is fixed on the transfer paper P by a fixing device (not shown).

Rotation of the photosensitive drum 1 in the direction of the arrow a is continued. Then, residual toner is removed from the surface of the photosensitive drum 1 by the cleaning device 10 and residual electric charge is erased from the surface of the photosensitive drum 1 by the main eraser lamp 11.

Then, control of toner density of the first and second developing devices 4 and 7 is described. Before a target image is formed, the above described image forming process is carried out. Thus, reference latent images are formed at portions in the non-print area D4 and then, are developed into reference images R1 and R2 by the first and second developing devices 4 and 7, respectively. Namely, the reference image R1 is formed of the color toner by the first optical system 3 and the first developing device 4 in the developing area D5 developed exclusively by the first developing device 4. Subsequently, the reference image R2 is formed of the black toner by the second optical system 6 and the second developing device 7 inwardly of the developing area D5 developed exclusively by the first developing device 4.

Accordingly, since the developing area D5 in which the reference image R1 is formed is disposed outwardly of the developing area D2 of the second developing device 7 provided downstream of the first developing device 4, such a phenomenon does not occur that the magnetic brush of the second developing device 7 containing the black toner rubs against the reference image R1 formed of the color toner. Therefore, the black toner is not recoated on the reference image R1 formed of the color toner, nor does it mix with the color tone of the reference image R1.

Then, the reference images R1 and R2 formed on the surface of the photosensitive drum 1 are transferred onto a margin of the transfer paper P by the transfer charger 8 such that densities of the reference images R1 and R2 are respectively detected by a density sensor 20 provided at one side of the tractor 9. The density sensor 20 is of an optical type having a light emitting element and a photo detector. Light is irradiated from the light emitting element to each of the reference images R1 and R2 transferred to the transfer paper P and the reflected light is detected by the photo detector such that a signal indicative of an electric potential corresponding to quantity of the reflected light is applied to the toner replenishment control circuit 15. Namely, in the density sensor 20, the quantity of the reflected light is detected from an amount of the toner adhering to the transfer paper P and is converted into a voltage such that the voltage is outputted. Meanwhile, since the quantity of the reflected light varies according to the colors of the reference images R1 and R2, two light emitting elements and two photo detectors are provided for the reference images R1 and R2 in the density sensor 2.

The toner replenishment control circuit 15 compares the densities of the reference images R1 and R2, which are expressed by the voltages inputted from the density sensor 20, with reference densities, which are expressed by reference voltages stored beforehand, respectively. If the density of the reference image R1 or R2 is lower than the corresponding reference density, a toner replenishment signal is generated such that the corresponding one of the first and second developing devices 4 and 7 is replenished with the toner from the toner replenishing device 12 or 13. Meanwhile, since the reference image R1 formed of the color toner is not mixed with the black toner as described above, it can be concluded that results of detection performed by the density sensor 20 indicate contents of the toners in the first and second developers of the first and second developing devices 4 and 7 accurately. Therefore, the first developing device 4, not to mention the second developing device 7, is replenished with a proper amount of the toner. Thus, such inconveniences are not incurred that obscure images are formed due to lack of the toner and that the toner which has not been electrically charged is scattered in the vicinity of the first and second developing devices 4 and 7 due to oversupply of the toner so as to contaminate in the image forming apparatus K.

Figure 3:
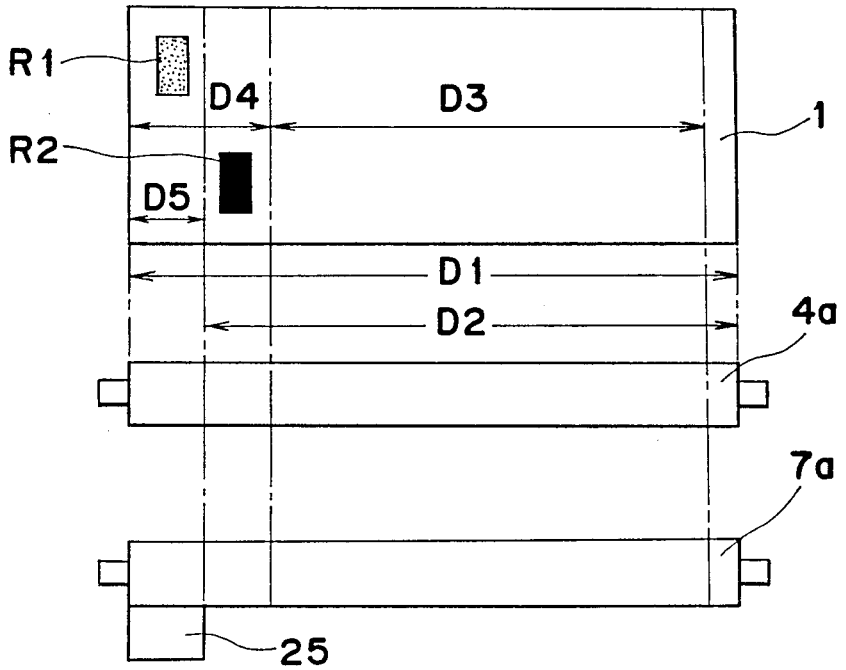
FIG. 3 is a view similar to FIG. 2, particularly showing a modification thereof.

In the above described embodiment, the developing sleeve *7a* of the second developing device 7 is made smaller, in length, than the developing sleeve *4a* of the first developing device 4 such that the developing area D5 is defined. However, in order to define the developing area D5 which is not developed by the second developing device 7, it can also be so arranged as follows. Namely, the magnetic roller *7b* incorporated in the developing sleeve *7a* is made smaller, in length, by the length of the developing area D5 than the magnetic roller *4b* of the first developing device 4. Alternatively, the developing sleeves *4a* and *7a* and the magnetic rollers *4b* and *7b* are made identical, in length, with each other and the first and second developing devices 4 and 7 are caused to deviate in position from each other. Furthermore, it can also be so arranged as shown in FIG. 3 that a blade 25 in contact with the outer peripheral surface of the developing sleeve *7a* is provided in the second developing device 7 disposed downstream of the first developing device 4 so as to scrape off the magnetic brush at one end portion of the developing sleeve *7a*.

Meanwhile, in the above described embodiment, after the reference images R1 and R2 have been transferred onto the transfer paper P, the densities of the reference images R1 and R2 transferred onto the transfer paper P are detected by the density sensor 20 provided at the side of the tractor 9. However, it can also be so arranged that the density sensor 20 is provided between the second developing device 7 and the transfer charger 8 such that the densities of the toners are directly detected from the reference images R1 and R2 on the photosensitive drum 1.

Furthermore, although the two-color printer utilizing the color toner and the black toner has been described in the above described embodiment, it is needless to say that the present invention is also applicable to image forming apparatuses other than the two-color printer, for example, an image forming apparatus provided with a plurality of developing devices containing toner of an identical color and an image forming apparatus provided with three or more developing devices.

Meanwhile, in the above described embodiment, the image forming apparatus is provided with two corona charging means, two exposure means and two developing means. However, it should be noted that the present invention is not so limited thereto but also applicable to any image forming apparatus provided with at least two developing means. For example, if the present invention is applied to an image forming apparatus provided with merely a plurality of the developing devices, in which a plurality of transfer processes for different colors are performed so as to recoat the colors on the transfer paper, it becomes possible to eliminate mixing of the colors at the downstream developing devices.

As is clear from the foregoing description, in the image forming apparatus of the present invention, the reference latent image for the upstream developing device is formed outwardly of the reference latent image for the downstream developing device and the developing area of the downstream developing device is disposed inwardly of the reference latent image for the upstream developing device.

Accordingly, since the downstream developing area does not overlap the upstream reference image, such an undesirable phenomenon does not take place that the toner is supplied to the upstream reference image from the downstream developing device, thereby resulting in mixing of colors of the upstream reference image. Thus, the densities of the toners obtained by detecting the quantities of reflected light from the reference images accurately indicate the contents of the toners in the developers contained in the respective developing devices. Therefore, density of a printed image obtained finally is maintained at a proper level and it becomes possible to prevent oversupply of the toner leading to contamination of peripheral devices.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. An image forming apparatus comprising:

a rotatable support member on which an electrostatic latent image is formed, said rotatable support member being rotatable about a rotational axis;

a corona charging means for electrically charging a surface of said support member;

an exposure means for exposing an image onto said support member;

a first developing means which is so provided as to confront said support member and has an effective developing width enabling development of a first area of said support member in which the electrostatic latent image is formed;

a second developing means which is so provided as to confront said support member upstream of said first developing means in a rotational direction of said support member and has an effective developing width enabling development of a second area of said support member, said second area including said first area and a third area located adjacent said first area in a direction parallel to said rotational axis, said third area being prevented from development by said first developing means;

a first means for forming, in said third area, a first reference latent image for detecting a density of the image;

a first detection means for detecting a density of a first reference toner image obtained by developing the first reference latent image by said second developing means; and a first control means for controlling, on the basis of a detection signal from said first detection means, the density of the image formed by said second developing means.

2. An image forming apparatus as claimed in claim 1, further comprising:

a second means for forming, in the first area developed by said first developing means, a second reference latent image for detecting the density of the image;

a second detection means for detecting a density of a second reference toner image obtained by developing the second reference latent image by said first developing means; and a second control means for controlling, on the basis of a detection signal from said second detection means, the density of the image formed by said first developing means.

3. An image forming apparatus as claimed in claim 1, wherein said first developing means and said second developing means contain toners having different colors, respectively.

4. An image forming apparatus as claimed in claim 1, wherein said first detection means detects the density of the first reference toner image formed on said support member.

5. An image forming apparatus as claimed in claim 1, wherein said first detection means detects the density of the first reference toner image transferred onto a paper sheet.

6. An image forming apparatus comprising:

a rotatable support member on which an electrostatic latent image is formed, said rotatable support member being rotatable about a rotational axis;

a corona charging means for electrically charging a surface of said support member;

an exposure means for exposing an image onto said support member;

a first developing means which is so provided as to confront said support member and has an effective developing width enabling development of a first area of said support member in which the electrostatic latent image is formed;

a second developing means which is so provided as to confront said support member upstream of said first developing means in a rotational direction of said support member and has an effective developing width enabling development of a second area that is larger than that of said first developing means at least in a direction parallel to said rotational axis;

a first means for forming, in an area on said support member, a first reference latent image for detecting a density of the image;

said area being disposed not only in the second area to be developed by said second developing means but outside the first area to be developed by said first developing means;

a first detection means for detecting a density of a first reference toner image obtained by developing the first reference latent image by said second developing means; and a first control means for controlling, on the basis of a detection signal from said first detection means, the density of the image formed by said second developing means.

7. An image forming apparatus as claimed in claim 6, further comprising:

a second means for forming, in said first area, a second reference latent image for detecting the density of the image;

a second detection means for detecting a density of a second reference toner image obtained by developing the second reference latent image by said first developing means; and a second control means for controlling, on the basis of a detection signal from said second detection means, the density of the image formed by said first developing means.

8. An image forming apparatus as claimed in claim 6, wherein said first developing means and said second developing means contain toners having different colors, respectively.

9. An image forming apparatus as claimed in claim 6, wherein said first detection means detects the density of the first reference toner image formed on said support member.

10. An image forming apparatus as claimed in claim 6, wherein said first detection means detects the density of the first reference toner image transferred onto a paper sheet.

* * * * *